United States Patent [19]

Poterala

[11] Patent Number: 4,626,452

[45] Date of Patent: Dec. 2, 1986

[54] ADJUSTABLE SEALING DAMS FOR A COATING MACHINE AND METHOD

[76] Inventor: Robert J. Poterala, Rte. 15, Rocky Pointe Way, Greenville, S.C. 29607

[21] Appl. No.: 714,158

[22] Filed: Mar. 20, 1985

[51] Int. Cl.[4] ..... B05C 5/02; B05D 1/26

[52] U.S. Cl. ..... 427/356; 118/413; 118/415

[58] Field of Search ..... 118/407, 413, 415; 427/356, 358

[56] References Cited

U.S. PATENT DOCUMENTS

| | | | |
|---|---|---|---|
| 2,022,322 | 11/1935 | Pelton | 118/415 X |
| 2,190,809 | 2/1940 | Strauch | 118/413 |
| 2,918,899 | 12/1959 | Munton et al. | 118/413 |
| 3,169,082 | 2/1965 | Krikorian | 118/413 |

FOREIGN PATENT DOCUMENTS

| | | | |
|---|---|---|---|
| 425279 | 6/1911 | France | 118/415 |

*Primary Examiner*—John P. McIntosh
*Attorney, Agent, or Firm*—Cort Flint

[57] ABSTRACT

Apparatus and method for a coating machine of the type which comprises a vertically disposed coating blade (30) beneath which a traveling web (W) passes through the coating machine for application of a coating compound. A trough feed system (48) supports the weight of the coating compound in close proximity to the coating blade to define a metering gap (60) for metering the coating compound. An adjustable mounting assembly (32, 34) provides adjustment of the trough longitudinally with respect to the coating blade to thereby vary the width of the metering gap. A pair of adjustable end dams (B) are carried within the interior of the trough (48) for containing the width of the coating compound to that generally of the fabric (W). The end dam comprises an adjustable frame (C) having an adjustable frame section (72) which bears against the trough and adjusts to the shape of the trough when moved. A relatively stationary vertical leg (70) is braced against the coating blade. An end dam plate (D) is carried on the adjustable frame (C). The end dam plate is affixed (66, 94) within the trough. Air cylinders (98, 102) are provided for bracing the vertical frame section (70) against the coating blade and for bracing the adjustable section (72) against the interior contour of the trough.

27 Claims, 7 Drawing Figures

Fig. 4.
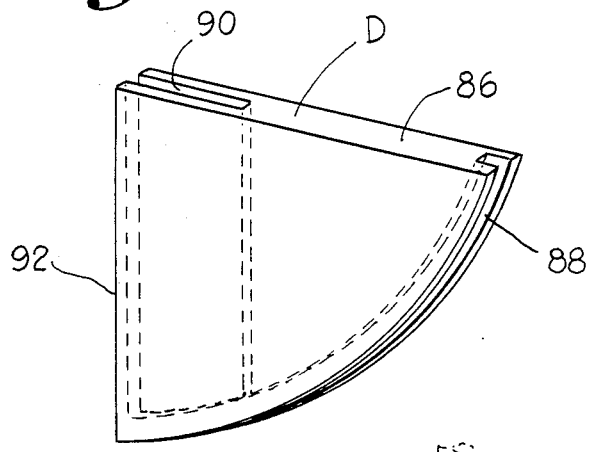
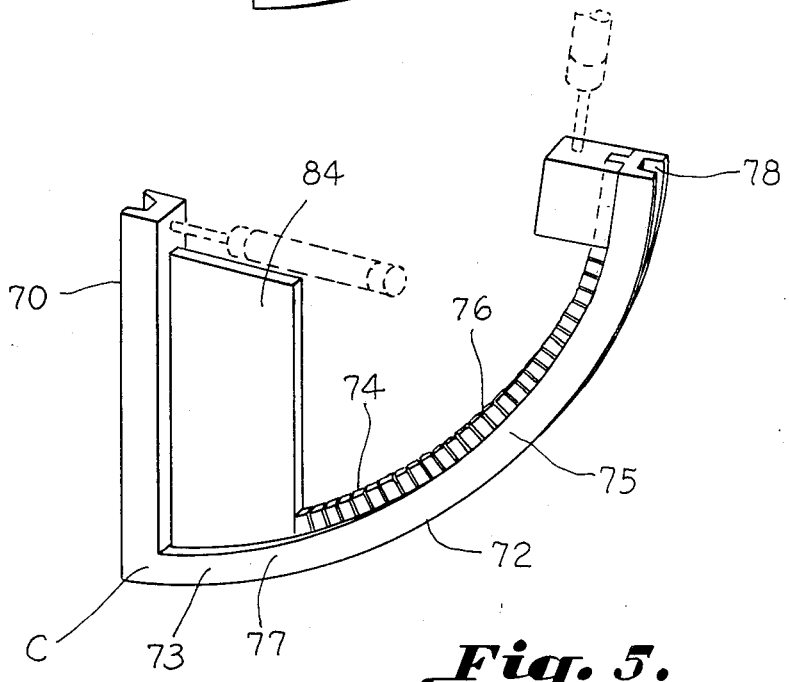
Fig. 5.

ADJUSTABLE SEALING DAMS FOR A COATING MACHINE AND METHOD

BACKGROUND OF THE INVENTION

The invention relates to the art of applying a coating compound to a web of fabric traveling through a coating machine. In particular, the invention relates to a type of coating machine which has a coating blade vertically arranged over a roller or other web support surface over which the web travels. A trough carried adjacent the coating blade supports a coating compound above the web of fabric. The trough and the coating blade are spaced apart to create a metering gap through which the coating compound is applied to the web.

One of the parameters for controlling the characteristics of the coating on the web is the amount of time that the coating compound remains on the fabric and is allowed to absorb before contacting the coating blade. This parameter is commonly referred to as the absorption rate of the coating compound. The absorption rate is directly proportional to the amount of time that the coating compound is allowed to stand over the area of the fabric prior to reaching the coating blade. In order to control the absorption rate, the width of the metering gap can be adjusted to narrow or widen the width of the coating compound on the fabric. If the metering gap is set wider, the coating compound will be allowed to stand on the fabric for a longer period of time prior to contacting the coating blade. In this instance, the coating compound will have a high absorption rate. In order to control the coating characteristic of the fabric, it is desirable to adjust the metering gap while the web is traveling through the coating machine.

The problem occurs that the metering gap in the prior coating machines cannot be readily adjusted while the web is traveling through the machine. One reason is that the trough of the coating machine normally includes a pair of laterally spaced sealing dams. The sealing dams contain the coating compound to the width of the web traveling through the machine. Excess coating compound at the fabric edges is reduced.

Sensors, such as electric eyes, are utilized to sense the edges of the fabric and adjust the lateral position of the sealing dams to follow the fabric edges. While the sealing dams are adjustable in the lateral position, no sealing dams have been heretofore provided which are adjustable in a longitudinal direction in which the web travels through the coating machine. To adjust the longitudinal position of the trough relative to the coating blade to vary the metering gap width has required that the coating machine be stopped. With the coating machine stopped, the trough is set in a desired position to provide a desired metering gap. The sealing dams are removed and interchanged with additional sealing strips or material placed around the dams in an effort to seal the dams in a different trough position which has not been entirely satisfactory. All of the foregoing takes considerable time and effort on behalf of the machine operator. Furthermore, while the machine is stopped, the coating compound is deposited on the web and absorbed in an uncontrolled fashion. This leaves a portion of the fabric having too much coating.

Laterally adjustable sealing dams for controlling the width of glue and the like applied to a roll are shown in U.S. Pat. Nos. 4,338,881, 4,327,662, and 3,936,549. However the foregoing are not adjustable in the direction of web travel nor suitable for adjusting to trough position in a trough over fabric feed system.

Accordingly, an important object of the present invention is to provide an apparatus and method for adjusting the width of the metering gap on a coating machine while a web of fabric is traveling through the coating machine.

Still another important object of the present invention is to provide adjustable sealing dams for containing the width of a coating compound on a coating machine wherein the sealing dams adjust longitudinally to automatically compensate for changes in a trough position to vary a metering gap on the coating machine.

Still another important object of the present invention is to provide an adjustable sealing dam for use in a coating trough of a coating machine which automatically adjusts to the longitudinal movement of the trough to maintain a fluid type dam on each end of a coating compound in the trough while the trough prevents the weight of the compound from sitting directly on the fabric to thereby control absorption into the fabric.

Still another important object of the present invention is to provide a sealng dam for a trough of a coating machine which is adjustable both laterally and longitudinally in the trough, yet is simple in construction, and is reliable during both movements in maintaining a fluid type seal of the coating compound.

SUMMARY OF THE INVENTION

The above objectives are accomplished according to the present invention by providing apparatus which controls the width of a coating compound applied from a trough to a web traveling in a longitudinal direction through a coating machine which automatically adjusts to longitudinal adjustment of the trough. The trough may be moved as desired to vary the width of a metering gap between the trough and a coating blade. The apparatus comprises an adjustable frame carried within the trough having a first section which braces against the coating blade, and a second frame section which conforms generally to the shape of an interior contour of the trough containing the coating compound. The second frame section moves relative to the first frame section to follow the contour of the trough as it is moved longitudinally. The first and second frame sections are braced against the coating blade and the trough interior respectively. A stationary dam plate is carried by the coating machine which is interconnected with the adjustable frame. As the frame adjusts longitudinally to follow the trough, the dam plate rides on interconnecting portions of the adjustable frame sections maintaining a fluid-tight seal for damming the lateral flow of coating compound within the trough. In a preferred embodiment, the adjustable frame of the sealing dam is provided by a vertical frame section and an arcuate frame constructed from a polymeric material wherein the frame and dam plate are interconnected by means of a serrated tongue formed on an arcuate section of the frame. The notched serrations impart flexure to the arcuate frame section to facilitate following of the trough contour. A floating groove is made in the dam plate which interconnects with the serrated tongue of the arcuate frame section and an interconnecting vertical flange on the vertical frame section.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a perspective view illustrating a dam plate for an adjustable sealing dam constructed in accordance with the present invention; and FIG. 5 is a perspective view illustrating an adjustable frame for an adjustable sealing dam constructed in accordance with the present invention.

DESCRIPTION OF A PREFERRED EMBODIMENT

Figure 1:
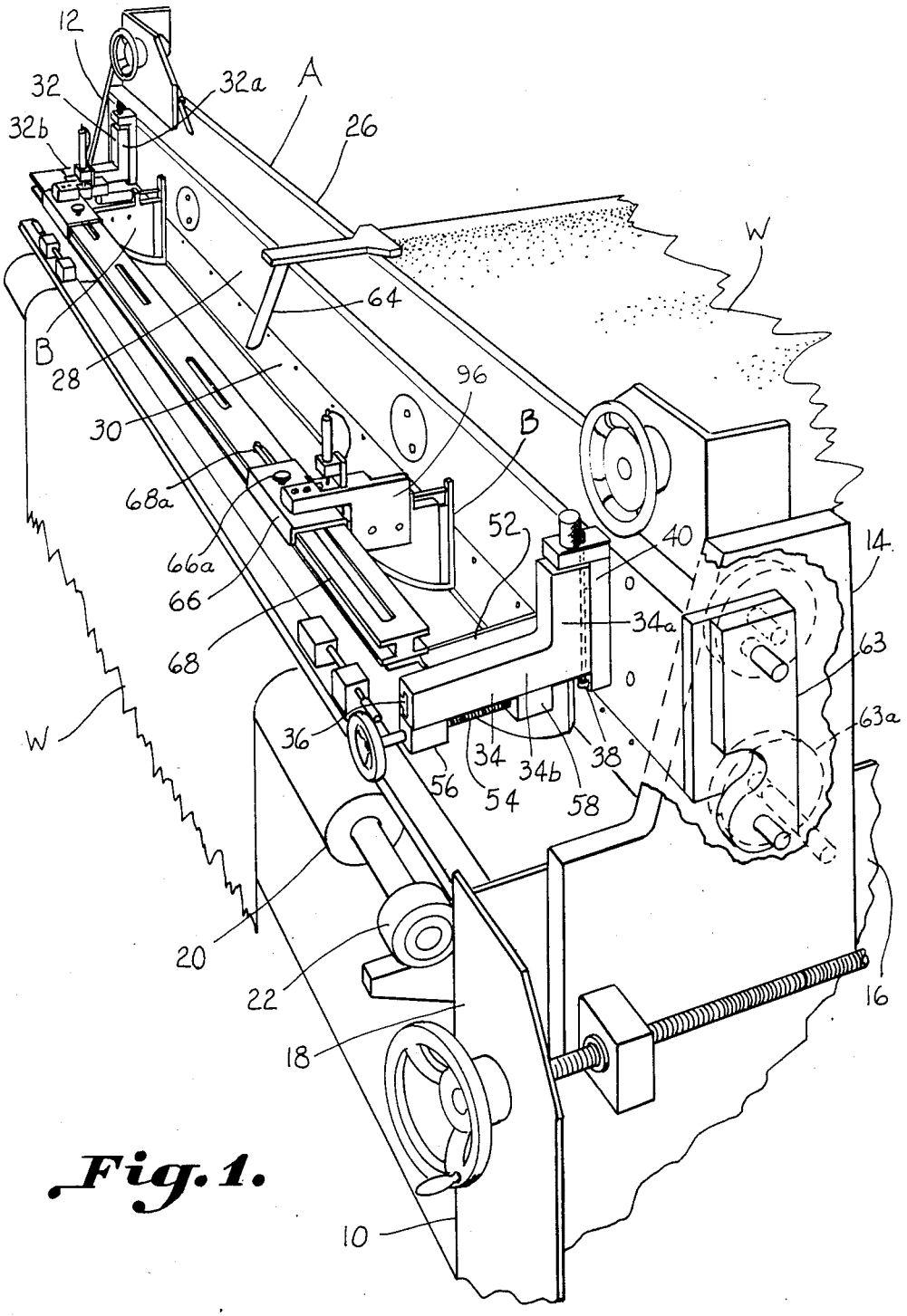
FIG. 1 is a perspective view illustrating a coating machine having adjustable sealing dams constructed in accordance with the apparatus and method of the invention.
Figure 3:
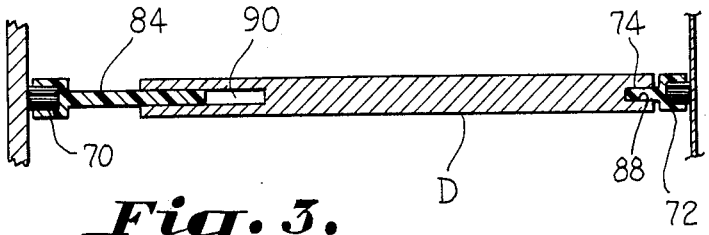
FIG. 3 is a sectional view taken along the line 3—3 of FIG. 2.

The invention relates to coating machine and, in particular, the type of coating machine which utilizes a trough feed system for support of a coating compound which is applied to a web of fabric passing underneath the trough. A coating knife blade is carried next to the trough for spreading the coating compound on and into the fabric surface of the web. There is a predetermined metering gap between an open edge of the trough and the coating blade to provide for a desired compound absorption rate. Laterally adjustable dam seals are carried in the trough to contain the coating compound within the width of the web of fabric traveling underneath the metering gap. A prior coating machine of the type described above is manufactured by the Mascoe Corporation of Mauldin, S.C. as model 4K and KRCIII.

Since the general features of the above described type of coating machine are known and may be had by reference to the above machine, only those aspects of the coating machine necessary to an understanding of the present invention will be described herein.

Referring now in more detail to the drawings, a coating machine is illustrated which includes a frame 10 having a pair of side frame base assemblies 12 and 14 which extend downwardly and form a base at the floor. Each side frame assembly includes a side plate 16 having a transverse front plate 18 and matching rear plate (not shown) which form a support base at each end of the coating machine. A guide roll 20 is rotatably journaled in a journal 22 affixed at each end of the machine frame over which a web W passes through the machine for coating.

A blade assembly unit A is carried between the side base frames 12 and 14. The blade assembly unit includes a top plate 26 generally bridging the side base frames and a blade back 28 affixed to the top plate 26. There is a coating knife blade 30 carried by the blade back 28.

Affixed to the top plate 26 and blade back 28 is an L-shaped bracket arm 32 and 34 at adjacent sides of the frame. The bracket arms may be affixed to the back plate 28 by any suitable means. As illustrated, the vertical arm 34*a* and 32*a* of each L-shaped bracket has a bore formed therein which slideably receives a mounting pin 38 carried by a mounting bracket 40. The arm 32*a* and 34*a* may slide up and down on the rod 38 and may be adjusted by means of a threaded positioning screw 42 threaded into the top of each arm. There is a T-shaped keyway 36 formed in the opposing faces of the bracket arms 32*b* and 34*b*.

Figure 2:
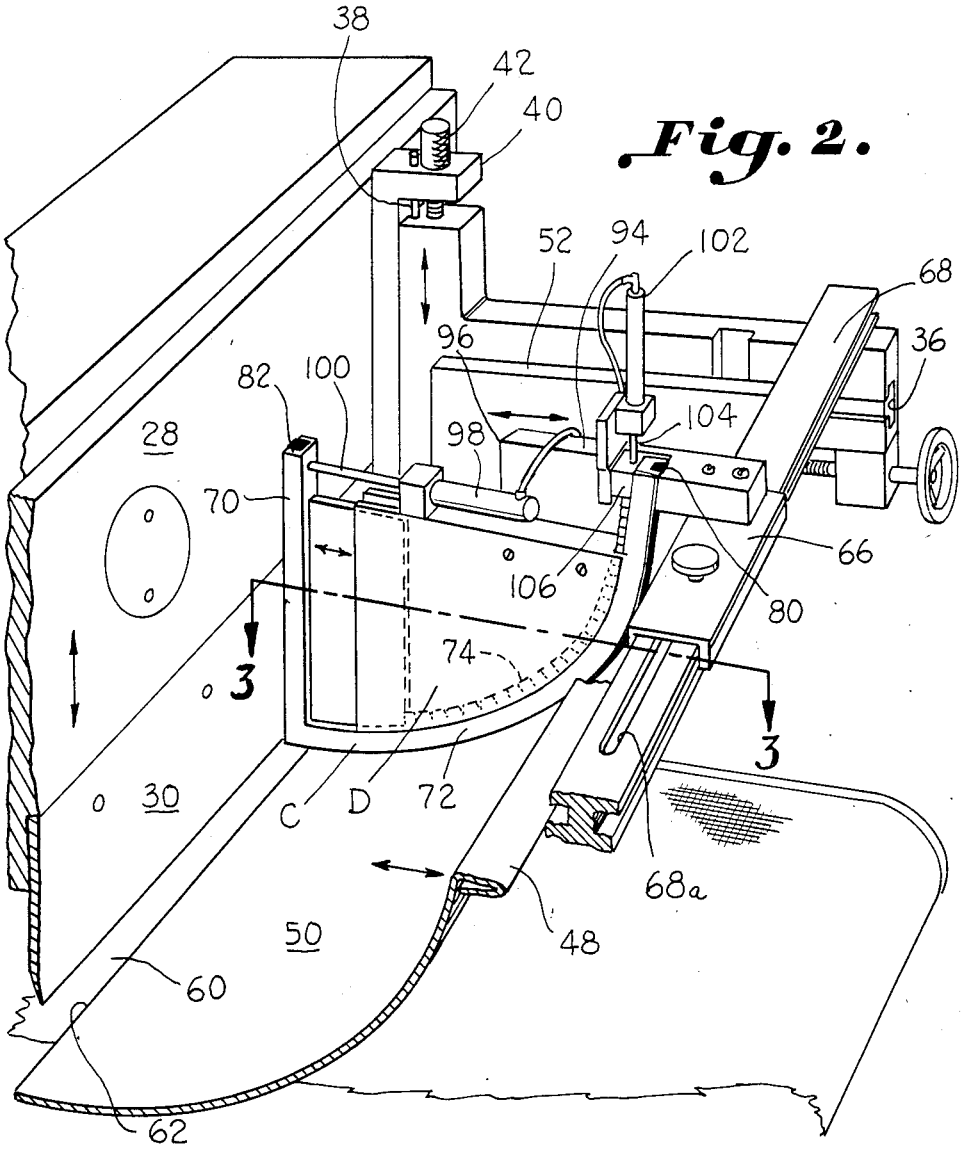
FIG. 2 is an enlarged partial perspective view illustrating an adjustable sealing dam constructed in accordance with the present invention.

A feed trough assembly carried by the bracket arms 32, 34, as can best be seen in FIGS. 1 and 2, includes a trough 48 having an interior contour 50 which has a generally arcuate shape. At each end of the trough 48 is an end plate 52. The outer face of each end plate 52 includes a T-shaped key (not shown) which fits within the keyway groove 36 to slideably mount the ends of the trough on the vertical arms 34*b* and 32*b* of the respective mounting brackets. There is a threaded rod 54 carried underneath each arm 34*b* and 32*b*. The threaded rod is journaled in a block 56 affixed to each arm, and threaded in a block 58 which is affixed to the end plate 52 of the trough. By turning the threaded rod 54, the trough 48 slides horizontally on the arms 34 and 32. In this manner, the longitudinal position of the trough relative to the frame 10 in the direction of web travel may be adjusted.

Since the L-shaped brackets 34 and 32 are affixed to the blade back 28, turning of the threaded rod 54 causes the trough 48 to move toward or away from the blade. A metering gap 60 is created between an open edge 62 of the trough 48 and the coating blade 30. When the position of the trough 48 is adjusted longitudinally, the metering gap 60 may be made wider or narrower to meter the coating compound onto the fabric and thus adjust the amount of absorption of the compound into the fabric.

The trough 48 supports the coating compounds above the fabric and prevents contact of the coating compound to control the absorption rate. Only that coating compound applied through the metering gap 60 contacts and absorbs into the fabric. A traversing nozzle 64 reciprocates laterally on the machine frame to deposit the coating compound into the trough. Turn wheels 65 are conntected to circular mounts 65a by way of universal type joints (not shown) to raise or lower the ends of the coating blade to adjust its vertical position. Further details of the structure of the coating machine for adjusting the trough and for adjusting the vertical position of the doctor blade may be had by reference to the above described coating machine manufactured by MASCOE Corporation.

The coating blade 30 and blade back 28 are carried between side plates 63 eccentrically connected to rotary hubs 63*a* journaled in the frame sides. The coating blade 30, blade back 28, and trough feed system are carried as a movable unitary blade assembly unit which moves in a backward arcuate motion to facilitate passage of a seam as disclosed in applicant's copending application entitled SEAM COMPENSATING APPARATUS AND METHOD FOR A COATING MACHINE, executed and filed herewith. Since the details of the movable blade assembly unit form no part of the instant invention, the details are omitted herein. Reference may be had for detail to the aforesaid disclosure as if incorporated herein.

Referring to FIG. 1, it can be seen that a pair of sealing end dams B are provided within the interior of the trough 48 to contain the width of the coating compound deposited within the trough to that of the fabric passing therebeneath. For this purpose, the lateral position of the dams may be automatically controlled. In the coating machine referred to above, an electronic eye is used to sense the edge of the fabric and move the dams accordingly to follow the edge of the fabric by means of air cylinders (not shown). The sealing dams B are affixed to brackets 66 which are slideably mounted on a guide plate 68 and moved by the air cylinders (not shown). The guide plate 68 is affixed to the end plates 52 of the trough 48 so that certain parts of the dams move with the trough.

Referring to FIGS. 2 through 5, adjustable sealing dams B are illustrated as including an adjustable frame C and stationary dam plate D. The flexible frame C adjusts to follow the contour of the arcuate trough 48 as the longitudinal position of the trough is varied on the machine. For this purpose, the adjustable frame means C is constructed from a polymeric material, preferably a thermoplastic such as Teflon. The frame means C includes a first frame section in the form of a vertical leg 70 which bears against the coating blade. There is a second flexible frame section which includes an arcuate leg 72 which bears against the interior contour of the trough 48. Arcuate leg 72 includes a serrated tongue 74 which consists of a number of notched serrations which renders the second frame leg 72 flexible so that it conforms to the shape of the arcuate trough interior as the trough moves.

A sealing groove 78 is provided around the exterior of the adjustable frame C for receiving a sealing strip 80 and 82 which seal against the surfaces of the trough interior and the coating blade respectively. This provides a seal regardless of relative blade movement with respect to leg 70 and trough movement with respect to leg 72. There is a vertical flange 84 which is integral with the vertical leg 70 and a first arcuate portion 73 of the arcuate leg 72. Thereafter, the serrated notches 74 of the tongue begin and continue over a second arcuate portion 75. A flexure junction 77 is created between the first and second arcuate sections.

While Teflon is a preferred material for the adjustable frame means C, due to its sealing properties and flexibility when serrated, it is to be understood that other suitable materials may also be utilized.

The dam plate D may be constructed from any suitable material such as an aluminum plate 86. The dam plate 86 includes a groove 88 around an arcuate edge thereof, and a vertical groove 90 formed in a straight edge 92. The groove 88 is received over the tongue 74 in a sealing relation. The groove 90 is received over the vertical flange in a sealing relation. The dam plate 86 and adjustable framing C are made for relative movement with respect to one another. The dam plate D and frame C are retained together by means of the tongue 74, flange 84, and grooves 88, 90.

The dam plate 86 is stationary and affixed to the trough 48 by means of the guide plate 68 and the slide bracket 66. The slide bracket 66 is slideably carried on the guide plate 68 by a groove **68*a* and slide bolt 66*a* arrangement. There is an arm 94 affixed to the slide bracket having a depending mounting plate 96** to which the dam plate D is affixed by any suitable means, such as screws.

The dam plate D is held held in a stationary position and moves with the trough as it is adjusted longitudinally. The adjustable frame C floats with respect to the dam plate when the longitudinal position of the trough 48 is changed. The arcuate leg 72 follows and conforms to the interior of the trough as it moves. The vertical flange 84 of adjustable frame and groove 90 of the dam plate move relative to each other to accommodate relative frame and dam plate movement. Slight relative movement may occur between the tongue 74 and groove 88 as arcuate leg 72 changes while the arcuate edge of the dam plate does not.

Means for bracing the frame sections against their respective mating surfaces is provided by air cylinders. There is a first brace means in the form of an air cylinder 98 affixed to the top of dam plate D. A plunger rod 100 actuated by the air cylinder 98 is affixed to the first frame leg 70 for bracing. The air cylinder 98 braces the frame leg 70 against the coating blade 30 and blade back 28. There is a second bracing means in the form of an air cylinder 102 affixed to the arm 94. There is a plunger rod 104 connected to a connecting block 106 which is affixed to the arcuate leg 72 by screws (not shown). The air cylinder 102 applies a downward force to brace the arcuate leg 72 against the interior contour of the trough 48.

By the above described adjustable sealing dam structure, a fluid seal is maintained for damming the lateral flow of the coating compound while the trough 48 is moved longitudinally to vary the metering gap 60. This may be done while the web fabric is traveling through the coating machine without application of excessive coating compound onto the fabric.

Thus it can be seen that the coating compound is effectively supported above the fabric and out of contact with the fabric except for the width of the metering gap 60. This gap may be varied while the web is traveling by turning the threaded rod 54 as desired. Absorption of excessive coating compound into the fabric during the adjustment is avoided. If the web were stopped, and the sealing dam exchanged as in the case of a nonadjustable sealing dam, the coating compound would be allowed to soak into the fabric during the stoppage. Further, the down time and effort required to change-out or adjust the seals of prior art end dams to accommodate adjustment of the trough is eliminated. Thus it can be seen that an advantageous construction for a longitudinally adjustable sealing dam is provided in accordance with the present invention whereby the width of a metering gap can be adjusted automatically without machine stoppage and absorption rate controlled thereby.

A method for controlling the absorption rate of coating compound into the surface of a web of fabric on which the coating compound is deposited on a coating machine is provided by the instant invention. The method comprises adjusting the metering gap while the web travels through the coating machine by providing adjustable end dams B in the trough which contain the width of a coating compound within the edges of a fabric passing through the coating machine A. A dam plate D and an adjustable dam frame C are provided for each of the end dams which are moveable relative to each other in a longitudinal direction in which the web W travels through the coating machine. A seal is provided between the dam frame and the coating blade and the trough interior. The dam frame adjusts to maintain a seal with the coating blade and the trough interior as the relative position of the coating blade and trough are adjusted to adjust the metering gap. The gap is thus varied while the web travels through the machine to control the absorption of coating compound onto the fabric while the fabric is traveling through the machine.

Figure 6:
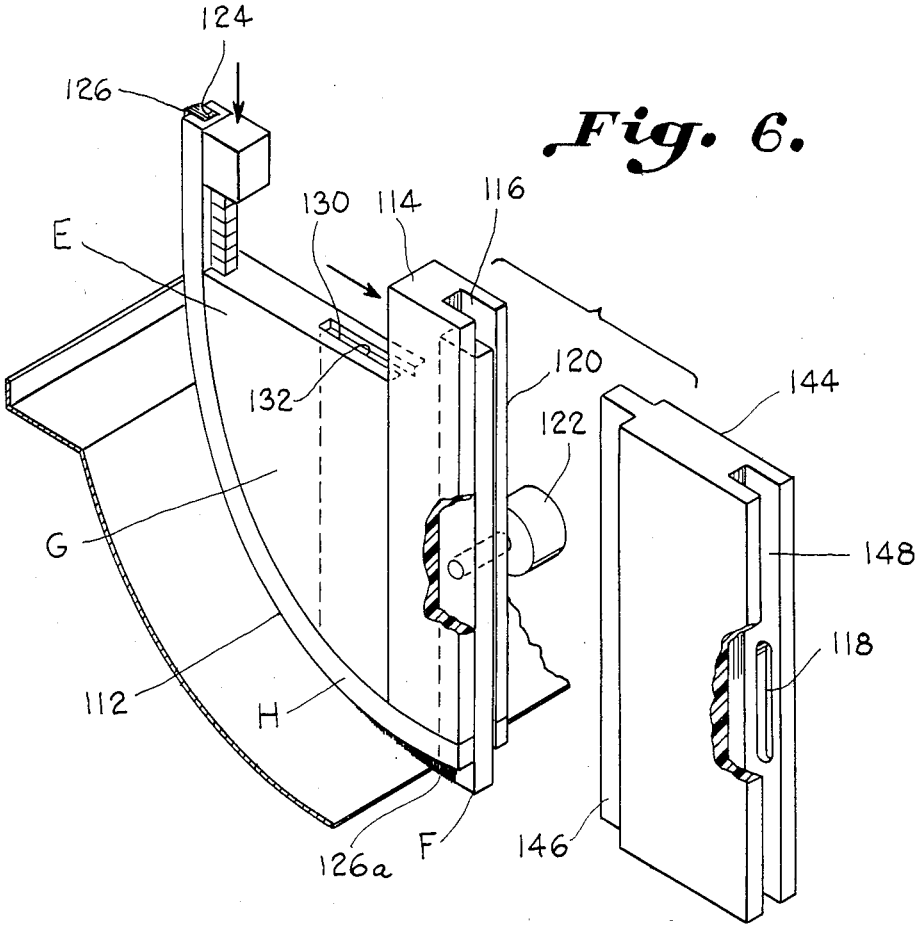
FIG. 6 is a perspective view of an alternate embodiment of a sealing dam constructed in accordance with the present invention.
Figure 7:
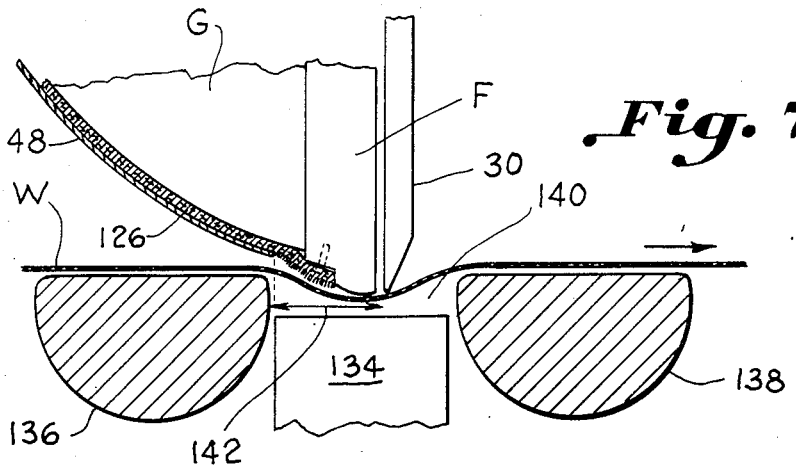
FIG. 7 is a side view illustrating the use of the invention of FIG. 6 over a gap table.

FIGS. 6 and 7 illustrate an alternate embodiment of an adjustable sealing dam E constructed in accordance with the present invention. In this embodiment, there is a floating tab F which floats vertically in response to fabric tension to occupy the metering gap 60 at the ends of the fabric width to prevent the escape of coating compound. The sealing dam E includes a plate G which is fixed to the trough in the same manner as plate D of sealing dam B. There is an adjustable frame H which interconnects with plate G to seal the coating compound and adjusts to the movement of trough 48.

The adjustable frame H is preferably made from Teflon and includes a serrated tongue 110 which renders the arcuate leg 112 flexible to follow the contour of trough 48 as it moves. The frame H includes a vertical leg 114 having a slide groove 116 which slideably receives the floating tab F. There is a slot 118 formed in one side 120 of leg 114 which receives a weight 122 threaded into the tab F to provide a biasing means for forcing the tab down against the fabric. The tab F may be a plastic or metal bar as illustrated. The weight 122 may include a widened annular surface (not shown) which can be tightened against the leg to hold it in a desired vertical position.

A groove 124 about the periphery of arcuate leg 112 receives a felt or rubber sealing strip 126 which forms a fluid seal against the trough surface. A free end 126*a* of the sealing strip is attached to the floating tab to further close off the space 128 in the metering gap 60 at the ends of the fabric width.

There is a vertical flange 130 as a part of leg 114 which is adjustably received in a slot 132 formed in dam plate G. As leg H flexes and adjusts to movement of trough 48, the flange 130 slides in slot 132 to maintain a dam configuration and seal as the ends of the coating compound corresponding to the fabric width.

The arcuate leg 112 and vertical leg 114 are braced against the trough and coating blade, respectively, as shown by arrows to maintain sealing contact therewith. Pneumatic means such as air-driven pistons are preferred for cleanliness. Air cylinders or other pneumatic means may be employed such as shown in FIGS. 2 and 5.

An extension 144 may be used when the trough 48 is moved away from the blade four to six inches instead of one to two inches. A vertical tongue 146 fits in groove 116 when the extension is utilized and tab F fits in slide groove 148.

The operation of the sealing dam will now be described in reference to FIG. 7. The coating blade 30 has been moved to a position where it is over a gap table 134. The gap table includes a table 136 and 138 between which is a gap 140. The fabric travels over the table and the knife blade is over the gap. As fabric tension varies, the floating tab F floats up and down on the fabric W. As the tab floats, the felt strip 126 and tab F seal the space 142 at the edges of the fabric at the ends of the gap 60, as can best be seen in FIG. 7. The edge of tab F or leg 114 abuts against the coating blade 30 to provide an adequate seal.

While a preferred embodiment of the invention has been described using specific terms, such description is for illustrative purposes only, and it is to be understood that changes and variations may be made without departing from the spirit or scope of the following claims.

What is claimed is:

1. Apparatus for controlling the width of coating compound applied from a trough to a traveling web and for automatically adjusting to changes in the width of a metering gap between the trough and a coating blade, wherein said trough has an interior contour for containing a level of coating compound, said apparatus comprising:

a pair of adjustable end dams carried within said interior contour of said trough spaced apart from one another;

each said end dam including an end dam frame means which includes a first leg stationarily braced against said coating blade, and a second leg integral with said first leg adapted for bracing against said interior contour of said trough;

a dam plate carried by said first and second legs being impervious to fluid for damming the lateral flow of coating compound in said trough;

said dam plate and frame means being movable relative to each other;

first bracing means acting on said first leg for maintaining said first leg braced and sealed against said coating blade while permitting relative vertical movement between said first leg and said coating blade;

second bracing means acting on said second leg to urge said second leg against interior contour of said trough;

said second leg being movable relative to said first leg so that said second leg acted on by said second bracing means follows said interior contour of said trough as said metering gap is changed in its width by movement of said trough; and dam plate retaining means interconnecting said dam plate and said first and second legs for retaining said dam plate and said first and second legs together during said relative movement maintaining a lateral fluid dam as said trough and second leg move in response to adjustment of said metering gap.

2. The apparatus of claim 1 including sealing means carried by said first and second legs for sealing against said coating blade and interior contour of said trough respectively.

3. The apparatus of claim 1 wherein said end dam frame means includes a flexure junction formed between said first and second legs facilitating flexure of said second leg relative to said leg.

4. The apparatus of claim 1 wherein said second leg of said dam frame means is flexible along a portion thereof to facilitate following of said interior contour by said second leg means as said trough position and metering gap are varied.

5. The apparatus of claim 4 wherein said retaining means includes a tongue formed in said first leg means and a groove formed in said dam plate for receiving said tongue whereby movement and a seal is provided between said dam plate and said second leg means.

6. The device of claim 1 wherein said second leg is formed from a polymeric material and includes a serrated tongue having a plurality of notched serrations which render said second leg flexible.

7. The device of claim 6 wherein said dam plate includes a groove for receiving said serrated tongue of said second leg whereby movement and a seal is provided between said dam plate and second leg of said end dam frame means.

8. The apparatus of claim 1 wherein said first and second bracing means comprise air cylinders.

9. The apparatus of claim 1 wherein said first bracing means is carried by said dam plate and urges said first leg against said coating blade.

10. The apparatus of claim 9 wherein said second bracing means is carried by said coating machine and urges said second leg of said end dam frame means against said interior contour of said trough.

11. The apparatus of claim 1 including a vertically floating tab slideably carried by said first leg of said frame means which floats up and down through said metering gap to reduce the escape of coating compound at the fabric edges at said end dams.

12. Apparatus for controlling the width of coating compound applied from a trough to a web traveling in a longitudinal direction through said machine and for automatically adjusting to changes in the width of a fluid material metering gap between an open edge of the trough and a coating blade, wherein said trough has an interior contour for containing a level of coating compound, said apparatus comprising:

an adjustable frame means carried within said trough interior conforming generally to the shape of said trough and bearing against said coating blade;

said adjustable frame means being adjustable in said longitudinal direction of web travel to thereby follow the movement of said contour of said trough as said trough is adjusted in its position relative to said knife blade;

bracing means for bracing said adjustable frame means against said coating blade and said trough interior;

a dam plate carried for relative movement with said adjustable frame means for damming the lateral flow of coating compound within said trough; and means for retaining said dam plate in a movable sealing relationship with said adjustable frame means as said adjustable frame means moves longitudinally to accommodate adjustment of said trough position.

13. The apparatus of claim 12 wherein said adjustable frame means includes:

a generally stationary first frame section; and a second generally movable frame section.

14. The apparatus of claim 13 wherein said bracing means braces said first frame section against said coating blade and braces said second frame section against said trough contour.

15. The device of claim 13 wherein said adjustable frame means includes:

a first generally stationary frame section carried against said coating blade;

a second generally movable frame section integral with said stationary frame section in contact with said interior contour of said trough; and means for sealing between said first and second frame sections respectively against said coating blade and interior contour of said trough.

16. The device of claim 12 wherein said adjustable frame means includes a frame having a frame section in contact with said interior contour of said trough which is flexible and conforms generally to the shape of said trough as said trough is adjusted in its longitudinal position relative to said coating blade.

17. The device of claim 16 wherein said frame section has an arcuate configuration;

said retaining means including a serrated tongue formed upon said arcuate frame section facilitating flexure of said frame section and following of said interior contour of said trough; and said dam plate comprising a groove in which said serrated tongue of said second frame section fits whereby a seal is provided by said tongue and groove as said second frame section flexes to follow said trough contour.

18. The device of claim including:

a vertical flange plate carried by said first frame section; and said retaining means including a slot formed in said dam plate which receives said vertical flange to form a slideable, moveable sealing contact between said dam plate and vertical flange.

19. The device of claim 12 wherein said adjustable frame means is constructed from a polymeric material.

20. A means for controlling the absorption rate of coating compound into the surface of a web of fabric on which said coating compound is deposited on a coating machine, wherein said coating machine is of the type which includes a trough in which a coating compound is contained having a free edge over which said coating compound is applied to said web, a coating blade spaced a predetermined distance from said free edge of said trough to create a metering gap for the application of said coating compound, and means for adjusting the position of said trough and coating blade relative to each other to vary said metering gap wherein the method comprises adjusting said metering gap while the web travels through the coating machine by the following steps:

providing a pair of adjustable end dams in said trough which limit the lateral flow of said coating material within the confines of the edges of said fabric passing through said coating machine;

providing a dam plate and an adjustable dam frame for each of said end dams which are moveable relative to each other in a longitudinal direction in which said web travels through said coating machine:

providing a generally continuous seal between said dam frame and the surface of said coating blade and said trough interior;

adjusting and maintaining said dam frame in sealing contact with said coating blade and said trough interior as the relative positions of said coating blade and trough are adjusted to adjust said metering gap while said web is traveling through said machine;

whereby said gap may be varied while the web travels through the machine to control the absorption of coating compound onto said fabric while said fabric is traveling through said machine.

21. Apparatus for controlling the width of coating compound on a coating machine of the type which comprises a vertically disposed coating blade which is disposed over a support surface, a traveling web traveling through said coating machine between said coating blade and said support surface for being coated with said coating compound; a trough carried by said coating machine in close proximity to said coating blade to define a metering gap therebetween through which coating compound is applied to said web; means for moving said trough longitudinally with respect to said coating blade to thereby vary the width of said metering gap; a pair of end dams carried within the interior of said trough for containing the width of said coating compound contained therein to that generally of the width of fabric traveling through said coating machine; wherein each said end dam comprising an adjustable frame carried within said trough having an adjustable frame section which bears against said interior contour of said trough in a manner that the contour of said frame section adjusts to conform generally to the contour of said trough as said trough is moved in its longitudinal position to vary said metering gap; an end dam plate carried on said adjustable frame; means for carrying said end dam plate in said trough; and means for bracing said adjustable frame section against said coating blade and against said interior contour of said trough and for maintaining said adjustable frame section braced against said trough as said trough is adjusted in its longitudinal position to vary said metering gap while said web is traveling through said coating machine.

22. The apparatus of claim 21 wherein said frame comprises a polymeric material, and said adjustable frame section includes a flexible leg having a plurality of notched serrations which render said frame leg flexible for following said trough contour during adjustment of said longitudinal position thereof;

whereby said metering gap may be adjusted while said web is traveling through said coating machine to control the absorption rate of said coating compound onto said web.

23. Apparatus for controlling the width of coating compound applied from a trough to a web traveling in a longitudinal direction through said machine and for automatically adjusting to changes in the width of a fluid material metering gap between an open edge of the trough and a coating blade, wherein said trough has an interior contour for containing a level of coating compound, said apparatus comprising:

an adjustable frame carried within said trough abutting said trough and said coating blade;

a fixed dam plate carried by said adjustable frame for movement relative to said adjustable frame, said dam plate being affixed for movement with said trough;

said adjustable frame including a vertical leg generally abutting said coating blade; and a vertically floating tab carried by said vertical leg which floats up and down in said metering gap to ride on said fabric and prevent the escape of coating compound at the edges of said fabric.

24. The apparatus of claim 23 including biasing means urging said floating tab downwardly against said fabric.

25. The apparatus of claim 23 including a sealing strip carried about a periphery of said adjustable frame sealing against said trough interior, and an end of said strip being affixed to said tab so that an end portion of said strip floats vertically with said tab.

26. The apparatus of claim 23 wherein said adjustable frame is flexible and conforms in configuration to the contour of said trough as said trough moves toward and away from said coating blade.

27. The apparatus of claim 23 including brace means for bracing the adjustable frame against said trough and coating blade.

* * * * *